United States Patent [19]

Turner et al.

[11] Patent Number: 5,056,989

[45] Date of Patent: Oct. 15, 1991

[54] STAGE REPLACEMENT BLADE RING FLOW GUIDE

[75] Inventors: Joseph T. Turner; Anthony F. Ganci, both of Winter Park; Vernon J. Musko, Casselberry; George J. Silvestri, Jr., Winter Park, all of Fla.

[73] Assignee: Westinghouse Electric Corp., Pittsburgh, Pa.

[21] Appl. No.: 591,000

[22] Filed: Oct. 1, 1990

[51] Int. Cl.[5] ..... F01D 1/04

[52] U.S. Cl. ..... 415/189; 415/208.1; 415/220; 415/914; 29/889.21; 29/889.23

[58] Field of Search ..... 29/889.21, 889.22, 889.23, 29/889.7; 415/182.1, 183, 189, 190, 208.1, 220, 914

[56] References Cited

U.S. PATENT DOCUMENTS

| | | | |
|---|---|---|---|
| 1,949,474 | 3/1934 | Jacobsen | 415/208.1 |
| 3,690,786 | 9/1972 | Silvestri, Jr. | 415/914 |
| 4,900,223 | 2/1990 | Groenendaal, Jr. | 415/914 |

FOREIGN PATENT DOCUMENTS

| | | | |
|---|---|---|---|
| 0220930 | 5/1987 | European Pat. Off. | 416/95 |
| 0263098 | 12/1988 | German Democratic Rep. | 415/189 |

*Primary Examiner*—John T. Kwon
*Assistant Examiner*—Christopher M. Verdier

[57] ABSTRACT

Power output of a steam turbine is increased by removal of at least one stage of blading in order to increase mass flow through the turbine. A flow guide or annular ring is installed in the space in the inner cylinder or blade ring surrounding the area from which the blading stage has been removed. The flow guide has a radially inner surface conforming generally to the surface configuration of the inner cylinder surrounding the turbine blades. The flow guide presents a relatively smooth, continuous surface to inlet steam flow so that flow separation and turbulence are reduced with a corresponding increase in efficiency.

4 Claims, 1 Drawing Sheet

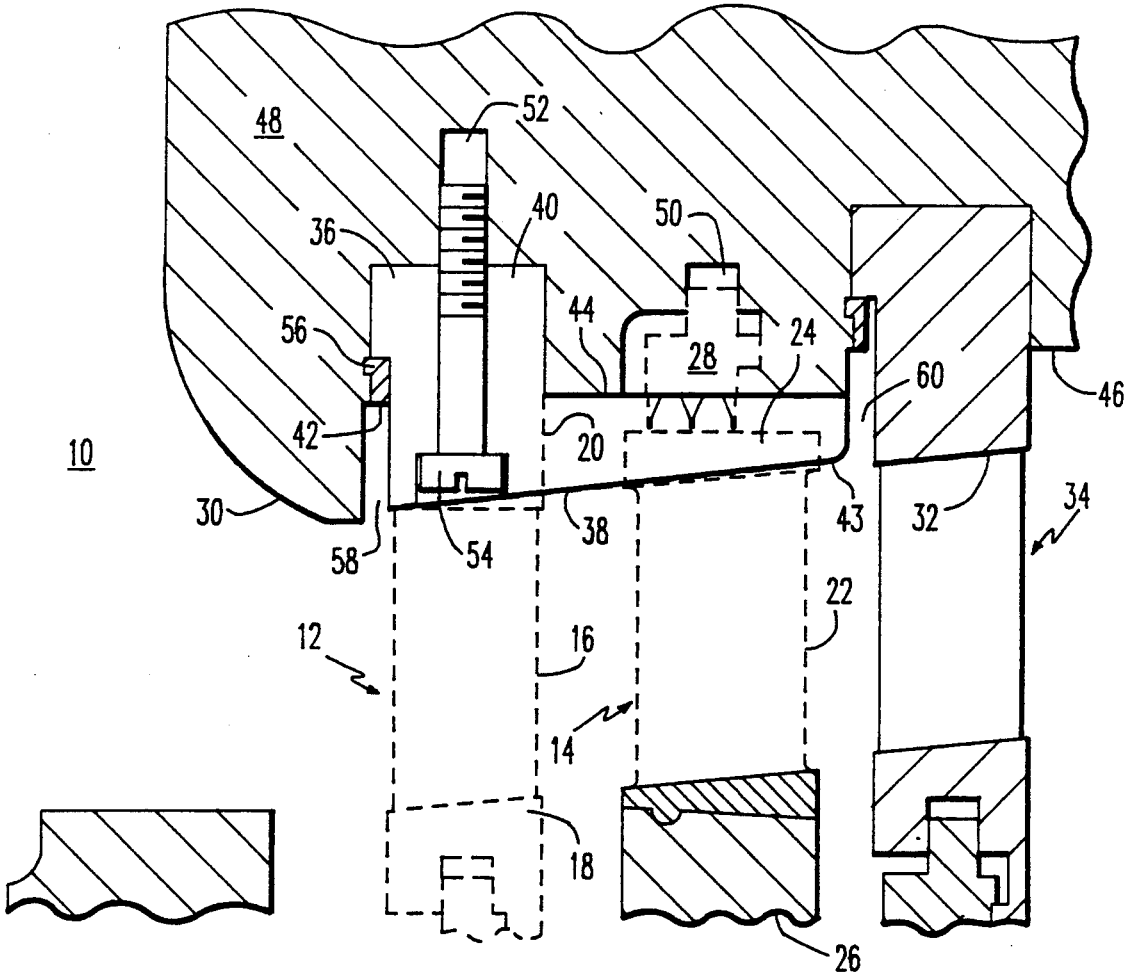
48
52
40
50
36
44
24
28
56
60
46
42
20
10
30
58
54
38
43
32
34
22
12
16
14
18
26

STAGE REPLACEMENT BLADE RING FLOW GUIDE

The present invention relates to steam turbines and, more particularly, to a method and apparatus for improved performance of turbines in which a stage and/or blade row has been removed.

BACKGROUND OF THE INVENTION

It is sometimes desirable to increase available power output of existing steam turbines at minimum cost. One method used for this purpose has been to remove at least one stage of blading comprising a stationary blade row and a rotating blade row near the turbine steam inlet in order to allow increased mass flow through the turbine. Depending upon the particular turbine and the desired result, different selected blade rows can be removed from the turbine. For example, removal of the second stage blading will allow an increase in pressure drop across the first stage blading and a concomitant increase in mass flow. The increased mass flow increases the available power output from the turbine, albeit at a slightly reduced efficiency.

In the past, removal of blade rows has entailed machining away of the airfoil section of each blade in a blade row. The blades may be from either stationary or rotating blade rows or combinations of both stationary and rotating blade rows. Rotating blade rows may be machined off at the blade platform and stationary blades may be machined off at their roots. Alternately, each blade may be removed in its entirety. In either case, removal of at least the airfoil section of the blades has resulted in discontinuities or uneven surfaces where the blades were removed. In general, where blades are machined off, the inner surface of the turbine cylinder is not smooth and may include labyrinth seals and attendant supports for stationary blades. When steam flows over these uneven surfaces, turbulence and flow separation occur which further reduces turbine efficiency. It is therefore desirable to reduce such turbulence and flow separation in order to minimize efficiency decreases when turbines are operating with less than the designed number of blade rows.

SUMMARY OF THE INVENTION

It is an object of the present invention to provide a method and apparatus for reducing steam turbine efficiency drops with blade rows removed.

It is another object of the present invention to provide a method and apparatus for reducing steam turbulence and flow separation in area of turbines in which blade rows are removed.

The above and other objects are attained in a steam turbine in which power output is increased by removal of at least one stage in order to increase mass flow through the turbine. In the case of a stationary blade row, the airfoil section of each blade in the row is machined away and the radially inner seal and seal carrier are removed from the turbine. In the case of a rotating blade row, the blade airfoil sections are machined away and the shroud or outer blade support removed from the turbine. A flow guide or annular ring is installed in the space in the inner cylinder or blade ring surrounding the area from which the blades have been removed. The ring has a radially inner surface conforming generally to the surface configuration of the inner cylinder surrounding the turbine blades. The annular ring presents a relatively smooth, continuous surface to inlet steam flow so that flow separation and turbulence are reduced with a corresponding increase in efficiency.

BRIEF DESCRIPTION OF THE DRAWINGS

For a better understanding of the present invention, reference may be had to the following detailed description taken in conjunction with the drawing in which:

FIG. 1 is a simplified, partial cross-section of a steam turbine inlet showing installation of a flow guide in accordance with the teaching of the present invention.

DETAILED DESCRIPTION OF THE INVENTION

The drawing illustrates an inlet end of a steam turbine 10 in which a stationary blade row 12 and a rotating blade row 14 have been removed in order to increase mass flow through the turbine and generate additional power above the original turbine rating. The portions of the blade rows 12 and 14 that are removed are illustrated in dotted lines. In the case of blade row 12, the entire blade can be removed as indicated by the dotted lines 16 representing the airfoil, the dotted lines 18 representing the blade inner ring support, and the dotted lines 20 representing the blade root. In the case of rotating blade row 14, the airfoil 22 and shroud 24 are removed while the platform 26 remains in place. However, it is also desirable to remove the labyrinth seal 28 positioned above the blade row 14.

As can be seen, with the root 20 removed along with shroud 24 and seal 28, there is a relatively discontinuous surface existing between the inlet flow guide surface 30 and the outer blade root surface 32 of the next stationary blade row 34. The surface 30 and blade root surface 32 form a steam flow line which directs steam flow into the airfoil sections of each following blade row. Applicants have discovered that the discontinuity in this flow surface causes turbulence and flow separation which in turn reduce efficiency of the turbine.

The drawing illustrates in cross-section one embodiment of a flow guide or annular ring 36 having an inner surface 38 forming a relatively continuous flow surface from inlet surface 30 to blade root surface 32. In the illustrative embodiment, the flow guide 36 includes an annular flange 40 which fits into the annular groove 42 previously reserved for the blade root 20 of the stationary blade row 12. The remainder 43 of the guide 36 has an outer surface 44 which abuts the inner surface 46 of the turbine inner cylinder 48, covering over the groove 50 in which seal 28 was seated. The flow guide 36 may be held in place by a plurality of circumferential spaced bolts 52 with heads 54 recessed below the surface 38. The bolts 52 are threadedly engaged in the inner cylinder 48. Packing 56 may be provided to prevent steam leakage around guide 36 and secures the flow guide in place. The gaps 58, 60 at each end of the guide 36 may be adjusted by use of different size guides 36 to provide appropriate clearance without creating undue turbulence.

While the drawing illustrates a flow guide 36 for the case of removal of both a stationary and a rotating blade row, it will be appreciated that an essentially similar guide could be used for a single blade row by removing the flange 40 if only a rotating blade row is removed or by removing the remainder 43 if only a stationary blade row is removed. Other annular ring-shaped flow guides may also be adapted for the application, it being understood that the relevant portion of the guide 36 is the inner annular surface 38 which provides a relatively continuous flow surface within the turbine.

While the principles of the invention have now been made clear in an illustrative embodiment, it will become apparent to those skilled in the art that many modifications of the structures, arrangements, and components presented in the above illustrations may be made in the practice of the invention in order to develop alternative embodiments suitable to specific operating requirements without departing from the spirit and scope of the invention as set forth in the claims which follow.

What is claimed is:

1. Apparatus for reducing flow separation and turbulence in a multiple blade row steam turbine in which at least one blade row has been removed, the apparatus comprising a flow guide installed in the turbine circumscribing an area from which the at least one blade row was removed, the flow guide having a radially inner surface substantially conforming to an inner steam flow surface of the turbine adjacent to the other blade rows whereby a relatively smooth inner surface is presented to steam passing through the turbine.

2. A method of increasing mass flow and power output of a multiple blade row steam turbine, the method comprising the steps of:

machining away an airfoil section of each blade of at least one blade row;

removing a radially outer seal circumscribing the at least one blade row; and installing a flow guide about the at least one blade row, the flow guide having a radially outer surface providing a relatively smooth surface conforming to an outer steam flow surface of the turbine adjacent to other turbine blade rows.

3. A method for reducing turbulence and flow separation in a steam turbine in which at least one blade row has been removed, the method comprising the steps of:

removing a radially outer blade support and a seal apparatus adjacent the at least one blade row; and installing a flow guide about the at least one blade row, the flow guide having a radially inner surface providing a relatively smooth surface conforming to an inner steam flow surface of the turbine adjacent other turbine blade rows.

4. The method of claim 3 wherein the flow guide comprises a plurality of sections each extending over a preselected circumference of the turbine, the step of installing including the step of bolting each section to a blade ring or inner cylinder of the turbine by means of radially extending bolts.

* * * * *